US005741172A

United States Patent [19]

Trionfetti et al.

[11] Patent Number: 5,741,172

[45] Date of Patent: Apr. 21, 1998

[54] DRIVE AND CONTROL DEVICE AND RELATED PROCESS FOR A GRINDING MACHINE

[75] Inventors: Gianni Trionfetti, Agrate Brianza; Andrea Guidotti, Milan, both of Italy

[73] Assignee: Balance Systems S.r.L., Milan, Italy

[21] Appl. No.: 644,196

[22] Filed: May 10, 1996

[30] Foreign Application Priority Data

May 12, 1995 [IT] Italy ..... MI95A0977

[51] Int. Cl.[6] ..... B24B 49/00

[52] U.S. Cl. ..... 451/21; 451/9; 451/10; 451/11; 451/49; 451/56; 451/443; 451/397; 33/1 PT

[58] Field of Search ..... 451/9, 10, 11, 451/49, 242, 397, 443, 21, 56; 33/1 N, 1 PT

[56] References Cited

U.S. PATENT DOCUMENTS

| | | | |
|---|---|---|---|
| 2,770,798 | 11/1953 | Roth | 33/1 PT |
| 3,590,534 | 7/1971 | Snyder | 451/159 |
| 3,604,271 | 9/1971 | Matson | 72/458 |
| 4,555,873 | 12/1985 | Smith | 451/21 |
| 4,637,171 | 1/1987 | Megnigat et al. | 451/21 |
| 5,183,026 | 2/1993 | Ohta et al. | 451/21 |
| 5,533,931 | 7/1996 | Imai et al. | 451/21 |

FOREIGN PATENT DOCUMENTS

| | | | |
|---|---|---|---|
| 0239161 | 3/1987 | European Pat. Off. . | |
| 0566853 | 3/1993 | European Pat. Off. . | |
| 0569774 | 4/1993 | European Pat. Off. . | |
| 352034497 | 3/1977 | Japan | 451/49 |
| 73213 | 3/1989 | Japan | 33/1 N |
| 2179880 | 8/1986 | United Kingdom . | |

*Primary Examiner*—Robert A. Rose
*Assistant Examiner*—George Nguyen
*Attorney, Agent, or Firm*—Browdy and Neimark

[57] ABSTRACT

It is provided a drive and control device for a grinding machine of the type comprising a rotatable abrasive wheel (2), translating members (3) of the wheel (3) with respect to a rotating piece (4) to be ground, and restoring means (5) to reset the wheel (2) comprising a diamond-resetting member (6) and a balancing member (7), the device comprising sensor members (10) adapted to detect the piece roundness and electronic means (19) adapted to generate actuating signals (23) of the restoring means (5), in the presence of a roundness of the piece (4) different from a predetermined roundness. The process consists in grinding the piece and simultaneously measuring the piece diameter until achievement of a predetermined diameter, detecting the piece roundness, and operating said restoring means in interlocked relationship with the detected roundness.

5 Claims, 2 Drawing Sheets

DRIVE AND CONTROL DEVICE AND RELATED PROCESS FOR A GRINDING MACHINE

BACKGROUND OF THE INVENTION

The invention relates to a drive and control device and related process for a grinding machine It is known that when a grinding machine is used to machine a piece having at least one circular section by means of an abrasive wheel, a margin of uncertainty may exist about the quality of the carried out working, depending on the condition of the abrasive wheel.

In fact, when machining of a piece having circular sections is concerned, the maintenance operations of the abrasive wheel are of the greatest importance, in view of achieving the desired qualitative level.

These operations particularly consist of balancing interventions carried out on the wheel using appropriate balancing members disposed along the wheel axis, and of interventions for dressing the grinding paste of the wheel by means of appropriate diamond-resetting members adapted to carry out said dressing.

Said operations are ideally to be repeated very often to keep high qualitative levels in machinings, but actually they should be avoided if they are not strictly necessary, in that they are time-consuming and in addition involve wear both of the wheel and the diamond-resetting tools, which results in high costs.

Practically, in establishing the frequency of the above operations an intermediate choice is done between these opposite requirements, based on the quality to be achieved each time It should be also noted that the good quality of this choice is ascertained by controls carried out on the already machined pieces, and these controls establish which pieces are to be discarded, which can be used and which need to be possibly machined again.

It is apparent that discarding of machined pieces or reinsertion of same in a working cycle involve important economical burdens.

Therefore in the management of a grinding machine there is a drawback in that it is necessary to carefully select each time the frequency of the maintenance operations to be executed on the abrasive wheel.

Every wrong choice involving a too reduced frequency leads to a decreased working quality of the machine and a too great number of pieces to be discarded. On the contrary, every wrong choice involving a too high frequency brings about high costs and reduced production rates.

SUMMARY OF THE INVENTION

Under this situation the technical task underlying the present invention is to devise a drive and control device and related process for a grinding machine capable of substantially obviating the drawbacks of the prior art, and in particular capable of optimizing the frequency of the balancing and diamond-resetting operations on the abrasive wheel, depending on the required quality level, and in addition capable of making the quality controls carried out on the pieces at the end of the machining operations substantially useless.

The technical task specified is substantially achieved by a drive and control device for a grinding machine of the type comprising a rotatable abrasive wheel, members for translating said wheel with respect to a rotating piece to be ground, and restoring means for said abrasive wheel comprising a diamond-resetting member adapted to dress said wheel and a balancing member for said wheel, the device comprising sensor members adapted to detect the roundness of said piece being machined, and electronic means adapted to process the detections carried out by said sensor members and, in the presence of a roundness of said piece different from a preestablished roundness, generate activation signals of said restoring means to reset said wheel.

The drive and control process for a grinding machine of the above type consists in: grinding said piece being machined and simultaneously measuring the diameter of said rotating piece until achievement of a predetermined diameter, detecting the roundness of said rotating piece at said predetermined diameter, while said piece is in engagement with said machine, and selectively operating said restoring means for said abrasive wheel in interlocking relationship with the detected roundness.

BRIEF DESCRIPTION OF THE DRAWINGS

The description of a preferred embodiment of the invention is now given by way of non-limiting example, with reference to the accompanying drawings, in which.

DETAILED DESCRIPTION OF THE INVENTION

Figure 1:
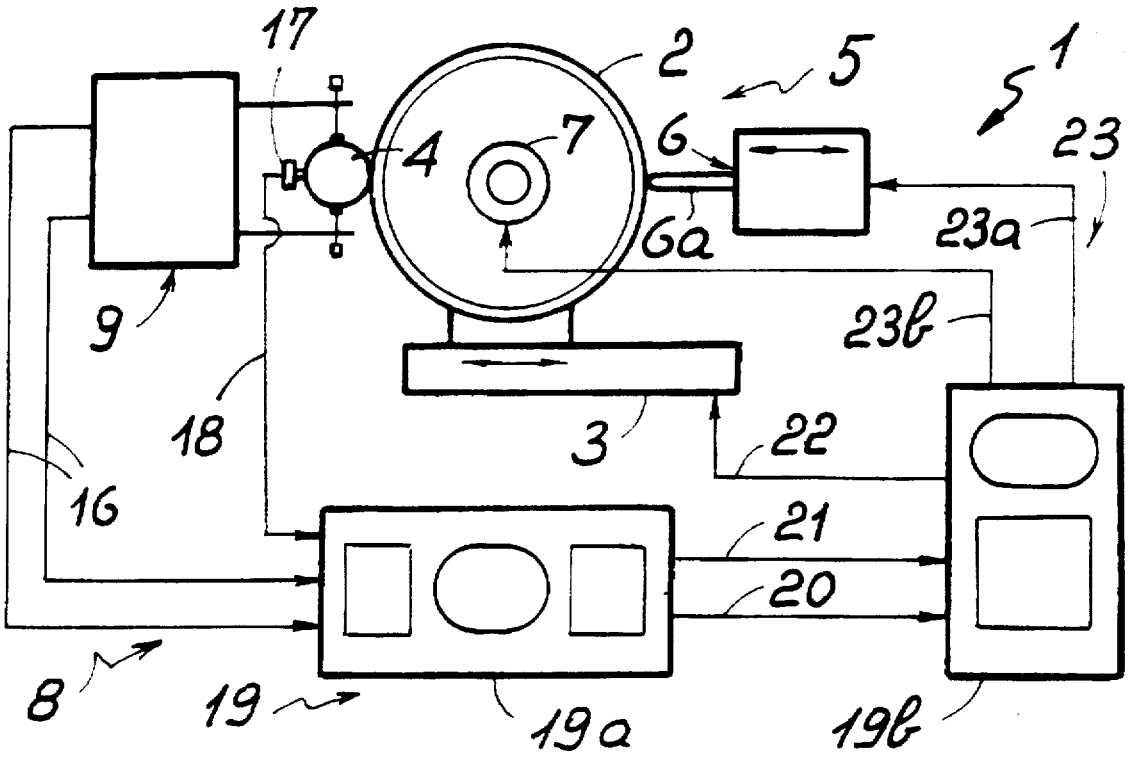
FIG. 1 shows the device applied to a grinding machine.

With reference to the drawings, the device in accordance with the invention is applied to a grinding machine identified by reference numeral 1.

In a manner known per se, the machine 1 comprises at least one rotatable abrasive wheel 2 rotation of which is obtained by an appropriate motor, an electric motor for example.

The abrasive wheel 2 is mounted on translating members 3 diagrammatically shown in FIG. 1 and embodied by a wheel slide capable of drivingly imparting all necessary movements to the grinding wheel 2 with respect to a piece 4 provided with at least one substantially circular profile to be ground.

Piece 4 too is rotated during the machining operation in that it is supported in known manner by a work spindle and set in rotation by a respective motor.

The machine 1 further comprises restoring means 5 for the wheel 2 capable of maintaining the wheel itself to optimal conditions.

In particular, the restoring means 5 comprises a diamond-resetting member 6 provided with a diamond-resetting tool **6*a* that can be located in contact with the grinding paste of the wheel 2, so as to dress it and give it the proper shape and abrasive capability again, and a balancing member 7 located close to the wheel 2** axis and capable of, by a suitable arrangement of excentric masses present therein, compensating for any wheel unbalance and the vibrations resulting from said unbalances when the wheel is rotating at high speed.

The device in accordance with the invention is generally denoted by 8 and comprises a measuring head 9 disposed close to the piece 4 being machined.

Figure 2:
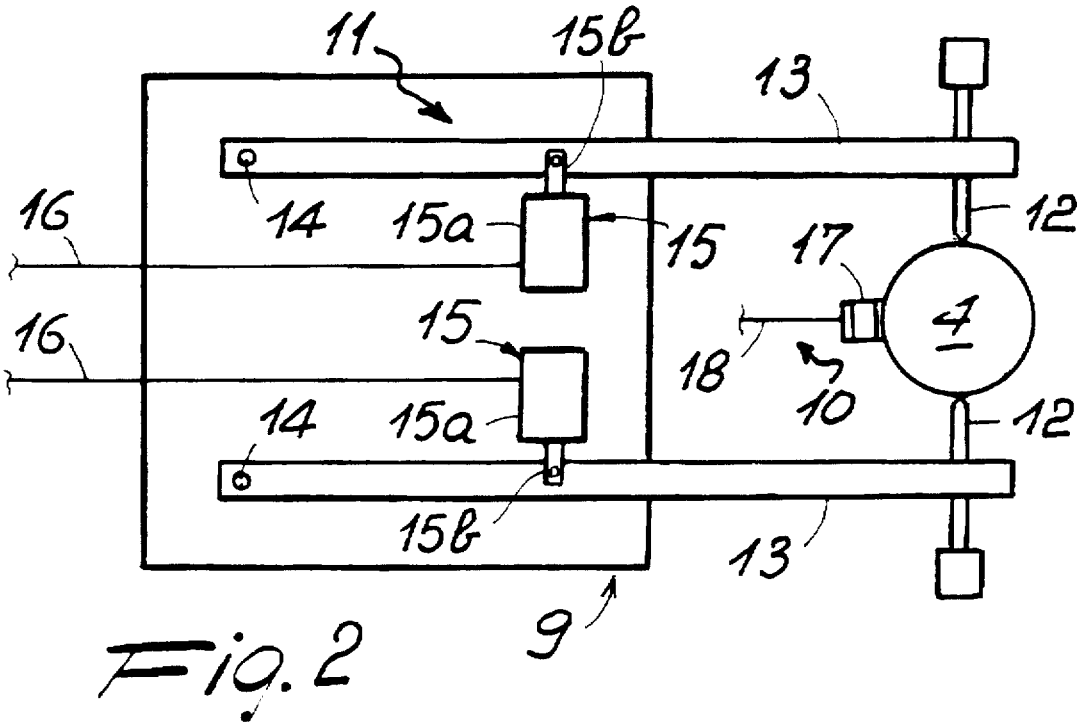
FIG. 2 shows a portion of the device.

The head 9, shown in detail in FIG. 2, is provided with sensor members 10, adapted to detect the roundness of the piece 4 being machined, that is, the circular roundness, circuitry, or circular shape; and feeler members 11 adapted to detect the diameter of the same piece 4.

Advantageously, the sensor members 10 and feeler members 11 are combined with each other, i.e. they partly use the same structural elements.

In detail, the feeler members 11 detecting the piece 4 diameter, consist of contact elements 12 adapted to engage the piece 4 being machined at diametrically opposite positions, swinging arms 13 supporting the contact elements 12 at one end thereof and rotatably fitted on fixed pins 14 at the other end, and two magnetic-inductive transducers 15 known per se, or transducers of another type, each of which is adapted to detect the movements of one swinging arm 13.

Shown in FIG. 2 are transducers 15 of the magnetic-inductive type, provided with a body 15*a* fitted to the measurement head 9 and a movable rod 15*b* capable of following the small oscillations of the swinging arms 13.

Each of the transducers 15 transmits specific movement signals of the swinging arms 13, via a cable 16.

The sensor members 10 detecting the roundness of piece 4, use part of the feeler members 11 and more particularly a contact element 12, a swinging arm 13 and one of the transducers 15, as well as cable 16.

In addition, the sensor members 10 comprise a phase sensor 17 adapted to detect the angular position of the piece 4 being machined and transmit a synchronization signal by a cable 18.

The phase sensor 17 can be disposed on the machine spindle to detect the angular position of the spindle itself and consequently that of piece 4.

Practically, while the feeler members 11 detect how the distance between two contact elements 12 (and therefore the diameter of piece 4) changes, the sensor members 10 verify the piece roundness, in that they detect how the position of each individual contact element 12 varies depending on the rotation angle of the piece 4, that is with reference to a predetermined zero position.

The device 8 further comprises electronic means 19 connected to the sensor members 10 and feeler members 11 and capable of generating signals to be utilized to advantage to operate the restoring means intended for resetting the grinding wheel 2.

In more detail, the electronic means 19 comprises at least first electronic means 19*a* processing detections from the sensor members 10 and feeler members 11 and capable of generating at least two types of signals: dimensional signals 20 stating the piece 4 diameter and signals 21 stating an insufficient roundness of the profile being machined, as compared with a predetermined profile.

In the embodiment shown in FIG. 1, signals 20 and 21 are transmitted to second electronic means 19*b* adapted to generate, after processing of the signals themselves, at least stop signals 22 addressed to the translating members 3 of the grinding wheel 2 and actuating signals 23 addressed to the restoring members 5.

Said actuating signals 23 consist of first actuating signals 23*a* addressed to the diamond-resetting member 6 and second actuating signals 23*b* addressed to the balancing member 7.

The stop signals 22 directed to the translating members 3 are in particular capable of causing the distance between the wheel 2 and piece 4 being machined to remain unchanged while the wheel 2 goes on rotating.

The first actuating signals 23*a* operate the diamond-resetting member 6 which carries out dressing of the grinding paste of the wheel 2, by moving the diamond-resetting tool 6*a* close to said wheel 2 while the latter is rotating. The elements converting signal 23*a* into movements of the diamond-resetting tool 6*a* are embodied by electrical actuators known per se.

The second actuating signals 23*b* bring into operation the balancing member 7 which compensates for unbalances of the abrasive wheel 2. Arrangement of a balancing member on the rotation axis of an abrasive wheel is usual and it is known that the balancing members generally are bodies internally provided with excentric masses to be positioned in a manner adapted to balance possible unbalances it, the abrasive wheel. Displacement of said excentric masses within the balancing members is achieved by rotators for example, and it is exactly provided that the second actuating signals 23*b* should actuate said rotators, possibly upon interposition of electrical members known per se, so as to change the position of said eccentric masses.

It is pointed out that the electronic means 19 according to the invention can be structured in different manners and they can be either disposed separately or arranged in a single unit.

Figure 3:
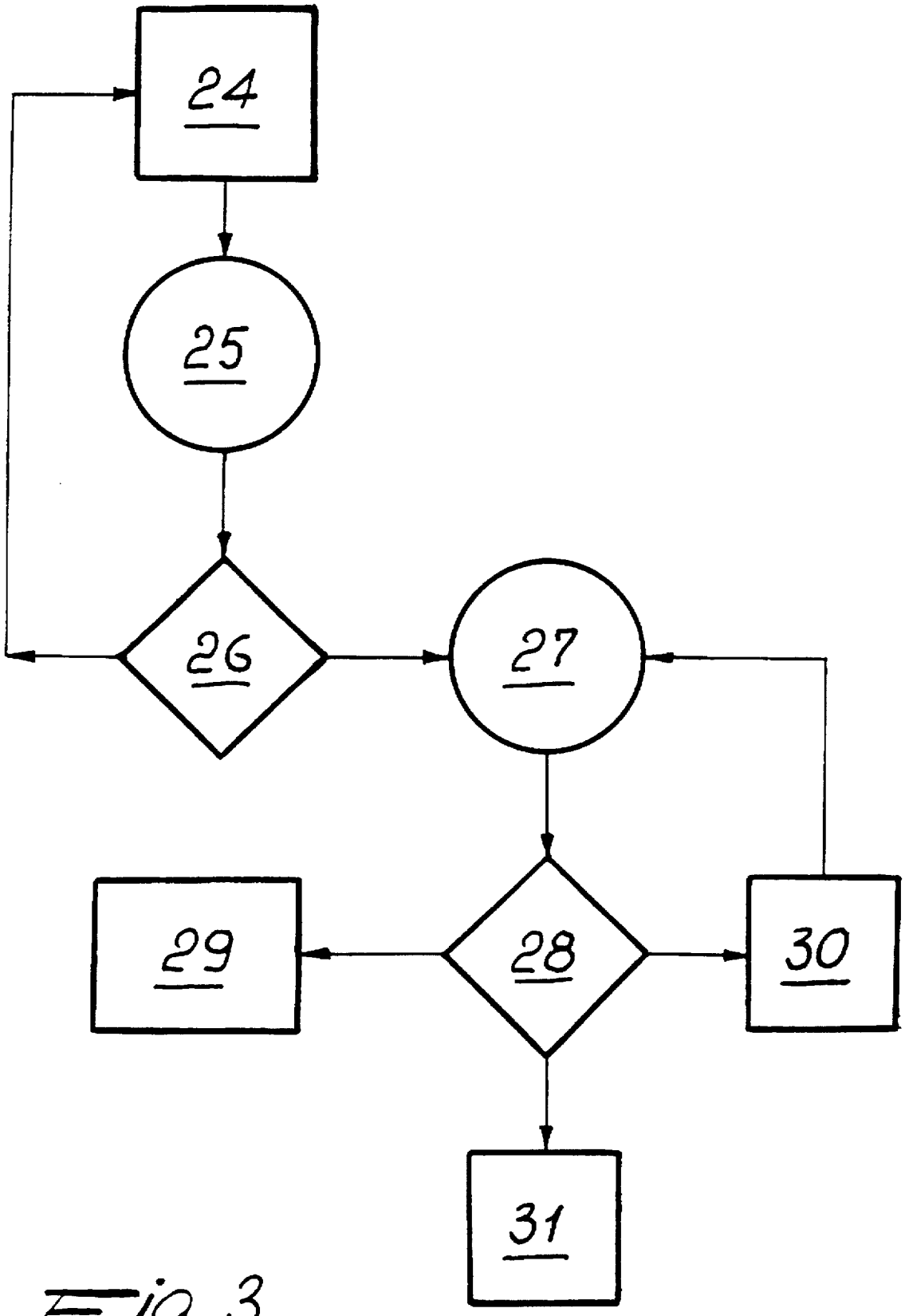
FIG. 3 shows the process embodied by the device.

In accordance with the drive and control process put into practice by the above described device, the following operating steps are carried out, as shown in FIG. 3.

First of all a piece being machined 4 is submitted to a grinding step 24 and simultaneously both measurements 25 of the diameter of the piece being machined and comparisons 26 between the gradually achieved diameters and the predetermined final diameter are carried out.

Signals signalling a not-yet-achieved final diameter cause the grinding step 24 of piece 4 to go on, while the abrasive wheel 2 gradually continues moving close to piece 4, upon the action of the translating members 3.

On achievement of the predetermined diameter, the translating members 3 are stopped and in step 27 the piece roundness is detected at the just-achieved diameter, the piece 4 being still in engagement with the machine 1.

The detected roundness is compared at 28 with the desired roundness and if a sufficient roundness has been achieved, stopping of the machine 1, at step 29, is driven. If, on the contrary, signals stating an insufficient roundness occur, first of all a rounding step 30 is carried out in which the grinding wheel 2 is caused to rotate in a grazing relationship with the piece 4, the translating members 3 being still in a stop condition.

Simultaneously, measurements of the piece 4 roundness and the duration of the rounding step 30 take place until the predetermined roundness is achieved.

In the presence of a prolonged duration of the rounding step exceeding a predetermined time, the rounding step 30 is stopped and the restoring means 5 for the abrasive wheel 2 are operated in step 31.

Usually the diamond-resetting member 6 is operated and only if the latter has not given the desired results, the balancing member 7 is operated as well. Thus, when the difference between an actual circular roundness of the piece and a predetermined circular roundness persists over a predetermined time interval, the diamond-resetting member and the balancing member are successively operated.

The invention achieves important advantages.

In particular, an automatic and optimal selection of the frequency of the maintenance and setting operations of the abrasive wheel is possible depending on the required qualitative level.

In this manner the work times and maintenance costs of the wheel are optimized and the machine shop rejections are drastically reduced with reference to the required qualitative level.

In addition, due to the fact that all geometrical features of the pieces being machined are measured directly on the machine tool and working is interlocked to these measurements, a subsequent quality control is avoided and supply of pieces of a constant quality is ensured.

We claim:

1. A drive and control device for a grinding machine of the type for grinding a rotatable piece, said piece having at least one circular cross section, the device comprising:

a rotatable grinding wheel;

means for translating said grinding wheel relative to the rotatable piece to be ground;

restoring means for restoring said grinding wheel, said restoring means including a diamond-resetting member for dressing said grinding wheel and a balancing member for balancing said grinding wheel;

circularity means for detecting the circular roundness of said piece at said circular cross section and for generating signals of circular roundness;

electronic means processing said signals and generating actuating signals for selectively operating said diamond-resetting member and said balancing member when a circular roundness of said piece is different from a predetermined circular roundness and for successively operating both said diamond-resetting member and said balancing member when a difference, of said circular roundness of said piece from said predetermined circular roundness, persists over a predetermined time interval.

2. A drive and control device for a grinding machine of the type for grinding a rotatable piece, said piece having at least one circular cross section, the device comprising:

a rotatable grinding wheel;

means for translating said grinding wheel relative to the rotatable piece to be ground;

restoring means for restoring said grinding wheel, said restoring means including a diamond-resetting member for dressing said grinding wheel and a balancing member for balancing said grinding wheel;

circularity means for detecting the circular roundness of said piece at said circular cross section and for generating signals of circular roundness;

electronic means processing said signals and generating actuating signals for selectively operating said diamond-resetting member and said balancing member when a circular roundness of said piece is different from a predetermined circular roundness;

diameter detecting means, for detecting the diameter of said rotatable piece, comprising at least two contact elements slidably engaging said rotatable piece at diametrically opposite positions;

at least two swinging arms each supporting a respective one of said contact elements; and at least two transducers each connected to a respective one of said swinging arms comprising means for detecting movements of said arms and transmitting diameter indicative signals to said electronic means;

and wherein said circularity means comprises at least one of said transducers and at least one phase sensor for detecting the angular position of said rotatable piece relative to a reference position and for emitting a synchronization signal;

said phase sensor being electrically connected with said electronic means.

3. A device for controlling operation of a rotatable grinding wheel in a grinding machine for grinding a rotatable piece to be ground, said piece having at least one circular cross section, the device comprising:

means for translating said grinding wheel relative to the rotatable piece;

restoring means for restoring said grinding wheel, said restoring means comprising a diamond-resetting member for dressing said grinding wheel and a balancing member for balancing said grinding wheel;

detecting diameter means for detecting a diameter of said rotatable piece at the circular cross section;

roundness-detecting means for detecting the circular roundness of said rotatable piece at said at the circular cross section;

said diameter detecting means including means to generate first signals indicative of the diameter of said rotatable piece and said roundness detecting means including means to generate second signals indicative of the circular roundness of said rotatable piece; and electronic means operatively connected with said diameter-and roundness-detecting means and with said restoring means, including means for processing said signals of said diameter-and roundness-detecting means and generating a stop signal for stopping said translating means upon occurrence of a diameter indicative signal corresponding to a predetermined diameter of said rotatable piece;

said electronic means further comprising means to generate actuating signals in a presence of a signal of insufficient circular roundness relative to a predetermined circular roundness of said rotatable piece; wherein said actuating signals are generating subsequently to said stop signal and include first and second actuating signals for selectively and successively operating said diamond-resetting member and said balancing member.

4. A drive and control process for a grinding machine of the type having a rotatable grinding wheel, means for translating said grinding wheel relative to a rotatable piece to be ground, said piece having at least one circular cross section, and means for restoring said grinding wheel, said restoring means comprising a diamond-resetting member for dressing said grinding wheel and a balancing member for balancing said grinding wheel; the process comprising the steps of:

i) grinding said rotatable piece and simultaneously measuring a diameter of said piece at said circular cross section until achievement of a predetermined diameter;

ii) detecting a circular roundness of said rotatable piece at said circular cross section upon achievement of said predetermined diameter while performing a rounding operation wherein said rotatable grinding wheel is maintained in grazing relationship with said rotatable piece; and iii) selectively and successively operating said diamond-resetting member and said balancing member when a duration of said rounding operation exceeds a predetermined time interval.

5. A process for controlling operation of a rotatable grinding wheel in a grinding machine of the type having means for translating said grinding wheel relative to a rotatable piece to be ground, said piece having at least one circular cross section, and means for restoring grinding wheel, said restoring means comprising a diamond-resetting member for dressing said grinding wheel and a balancing member for a balancing said grinding wheel; the process comprising the steps of:

i) grinding said rotatable piece and simultaneously detecting the diameter of said piece at said cross section;

ii) stopping said translating means upon achievement of a predetermined diameter of said piece;

iii) detecting a circular roundness of said rotatable piece at said circular cross section while performing a rounding operation of said piece wherein said grinding wheel is maintained in grazing relationship with said rotatable piece;

iv) stopping said rounding operation when a duration of said rounding operation exceeds a predetermined time interval;

v) operating said diamond-resetting member;

vi) restoring said rounding operation and newly detecting the circular roundness of said piece; and vii) operating said balancing member in the presence of a persisting detection of insufficient circular roundness of said piece.

* * * * *